United States Patent [19]

Bo

[11] Patent Number: 4,774,989

[45] Date of Patent: Oct. 4, 1988

[54] ARRANGEMENT FOR USE IN JOINING TOGETHER TWO PLATE-SHAPED ELEMENTS

[76] Inventor: Helge Bø, Bøvegen, N-5200 Os, Norway

[21] Appl. No.: 882,916

[22] PCT Filed: Oct. 17, 1985

[86] PCT No.: PCT/NO85/00066

§ 371 Date: Jul. 17, 1986

§ 102(e) Date: Jul. 17, 1986

[87] PCT Pub. No.: WO86/02400

PCT Pub. Date: Apr. 24, 1986

[30] Foreign Application Priority Data

Oct. 18, 1984 [NO] Norway ..... 844153

[51] Int. Cl.[4] ..... E06B 9/00

[52] U.S. Cl. ..... 160/229.1; 160/135

[58] Field of Search ..... 29/526 R, 462; 52/254–257, 280–282, 288, 582; 160/229 R, 231 A, 231 R; 217/65; 249/40, 41, 47, 194, 217–219

[56] References Cited

U.S. PATENT DOCUMENTS 4,144,924 3/1979 Hoek ..... 160/231.2

FOREIGN PATENT DOCUMENTS 1127107 12/1956 France ..... 160/231.2

*Primary Examiner*—Timothy V. Eley

*Attorney, Agent, or Firm*—Kenyon & Kenyon

[57] ABSTRACT

An arrangement for use in joining together two plate-shaped elements (10*a*, 10*b*, 18*a*, 18*b*), especially boarding members, which form an angle (a) usually 90°, with each other, comprises an angled means (11), one leg (12) of which extends substantially at right angles to the main plane of the one plate-shaped element (10*b*, 18*b*) and projects away from the second plate-shaped element (10*a*, 18*a*), and the other leg (13) of which extends substantially at right angles to the main plane of the second plate-shaped element (10*a*, 18*a*) and projects away from the first plate-shaped element (10*b*, 18*b*), legs (12, 13) of the angled means (11) forming abutments against a surface (14*a*, 14*b*) which is rigidly connected to the respective plate-shaped element and is detachably fastened to the latter.

12 Claims, 6 Drawing Sheets

ARRANGEMENT FOR USE IN JOINING TOGETHER TWO PLATE-SHAPED ELEMENTS

This is a continuation of co-pending application Ser. No. 886,444, now abandoned, filed on July 17, 1986 and which, in turn, is a continuation of Ser. No. 776,855 filed Sept. 18, 1985, now abandoned.

The present invention relates to an arrangement for use in joining together two plate-shaped elements, which form an angle, usually 90°, with each other.

In the boarding of posts, girders and the like there are employed according to known engineering practice, which has changed little the last 10–20 years, boarding elements which are held together by means of various collars or the like which are fastened with relatively short intermediate spaces around the boarding and thereby hold the individual boarding elements in position. This solution is very demanding on labour and time in that the collars have to be nailed to the boarding elements and have to be removed after use.

By the very fact that the boarding work in many casting operations constitutes a substantial portion of the costs, improvements are constantly being sought after, but as mentioned above without significant changes having been made in engineering in recent years.

The need for improvements is thus apparent, and the object of the present invention is to effect boarding of corners more rapidly and simpler and hence cheaper.

This is achieved by means of an arrangement which is designed as an angled means, one leg of which extends substantially at right angles to the main plane of the one plate-shaped element and projects away from a second plate-shaped element, and the other leg of which extends substantially at right angles to the main plane of the second plate-shaped element and projects away from the first plate-shaped element. The legs of the angled means forming abutments against a surface, which is rigidly connected to the respective plate-shaped element and is detachably fastened to the latter.

The invention will be further explained in the following description having regard to the accompanying drawings, in which:

FIG. 1 shows a horizontal section of an arrangement according to the invention for use in boarding of a corner in for example a post by means of boarding cassettes where the angle a between the boarding cassettes is 90°.

Each boarding cassette consists of two plates 10*a*, 10*a'* and 10*b*, 10*b'* respectively, which are usually made of plywood and which have a certain spacing, for example 10 cm. from each other. Each of these plates can alternately face towards the concrete. Between the surfaces there is arranged along their edges a U-shaped element, legs of which, such as the leg 16*a*, project outwardly as an extension of the plates i.e. in alignment with the plates. In addition the element is designed with an inwardly projecting flange which the plywood plates form an abutment against and which they are detachably fastened to by means of for example rivets (not shown).

Figure 1:
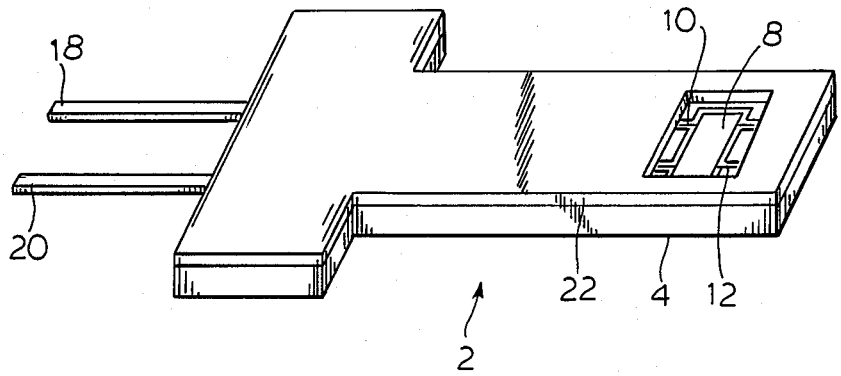
FIG. 1 shows a horizontal section where the arrangement according to the invention is employed for boarding of a corner in a post by means of boarding cassettes.

On boarding a corner, two boarding cassettes 10*a*, 10*b* are mounted at an angle a to each other as illustrated in FIG. 1. In the illustrated embodiment, the angle is as mentioned 90°, something which moreover is the most customary. An angled means 11 having legs 12, 13 which form an angle which is as large as, but opposite relative to the angle a between the cassettes 10*a*, 10*b*, is arranged between the outwardly projecting legs of the boarding cassettes. The angled means 11 forms thereby an abutment against the bottom 14*a*, 14*b* of the U-shaped element of the boarding cassette and forms with its free end 15*a*, 15*b* an abutment against the outwardly projecting leg 16*a*, 16*b* of the U-shaped element. At the top part the angled means 11 is as illustrated, angled in the form of steps, so that it forms an abutment against each U-shaped element, which is an extension of the inner plate 10*a*, 10*b*. In this way the angled means 11 will be arranged safely in position between the outwardly projecting members 16*a*, 16*b* and is fixed to the bottom 14*a*, 14*b* of the U-shaped element by such means as detachable bolts 17 or clamps. As a result, the unit which consists of the two boarding cassettes 10*a*, 10*b* and the angled means 11 will be held rigidly together with minimal possibilities for displacement relative to each other. Also the angled means 11 is usually made of aluminum, but can also be made of other materials, for example galvanised steel. The breadth of the means 11 can be varied, from a relatively narrow strip to the whole length or breadth of the boarding cassette, and the length of each leg corresponds to the distance between the plates of the cassette.

Figure 2:
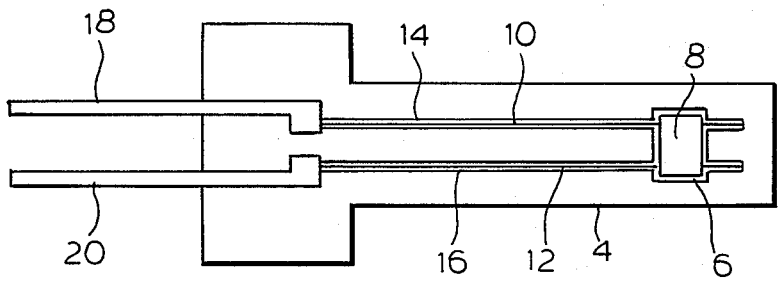
FIG. 2 shows a corresponding section to FIG. 1, but where the boarding is constructed by means of boarding members.

FIG. 2 shows a corresponding section to FIG. 1, where there are employed boarding members 18*a*, 18*b* instead of boarding cassettes. In this embodiment, an element 19*a*, 19*b* projects substantially at right angles outwardly from a respective boarding element 18*a*, 18*b* with projections 20*a*, 20*b* which the boarding member are detachably fixed to, for example by means of rivets not shown. The elements 19*a*, 19*b* extend over the whole respective length and breadth of the boarding member. A certain section which is not critical projects outwardly from the boarding member, but which is adapted to the length of legs 12, 13 of the angled means 11. At its free end, each of the elements 19*a*, 19*b* is angled, so that the free end of the means 11 forms an abutment against angled portion 21*a*, 21*b* of the respective element 19*a*, 19*b*, which extends in an opposite direction relative to projection 20*a*, 20*b* of the element. In a corresponding manner as in the embodiment of FIG. 1 the angled means 11 is fixed to the element 19*a*, 19*b* by means of bolts 22 or rivets, so that the means 11 can be detached in a simple manner from the element 19*a*, 19*b* after use. Also in this embodiment there is provided a reliable and good bracing and locking.

Figure 3:
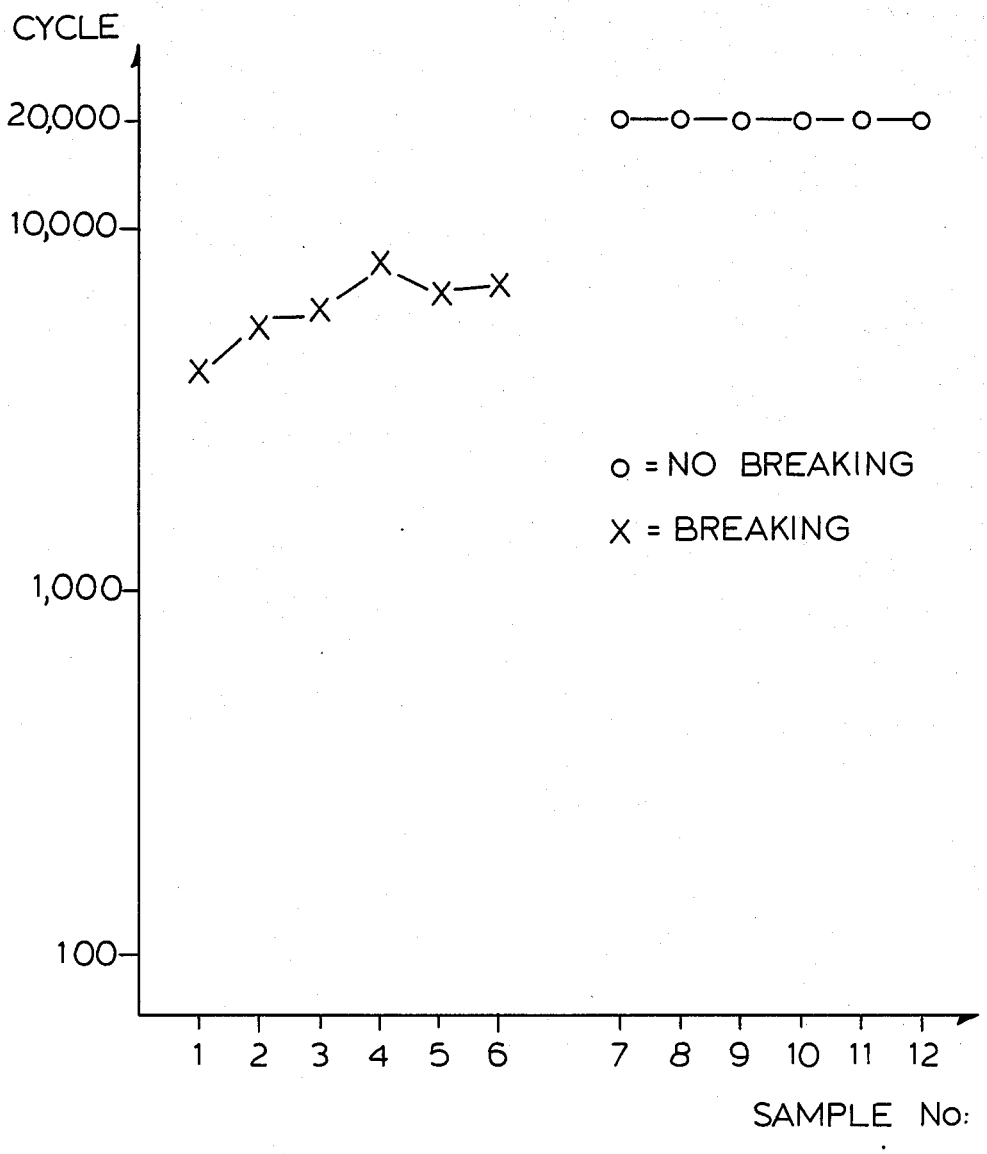
FIG. 3 shows a perspective view of the arrangement of FIG. 2.
Figure 4:
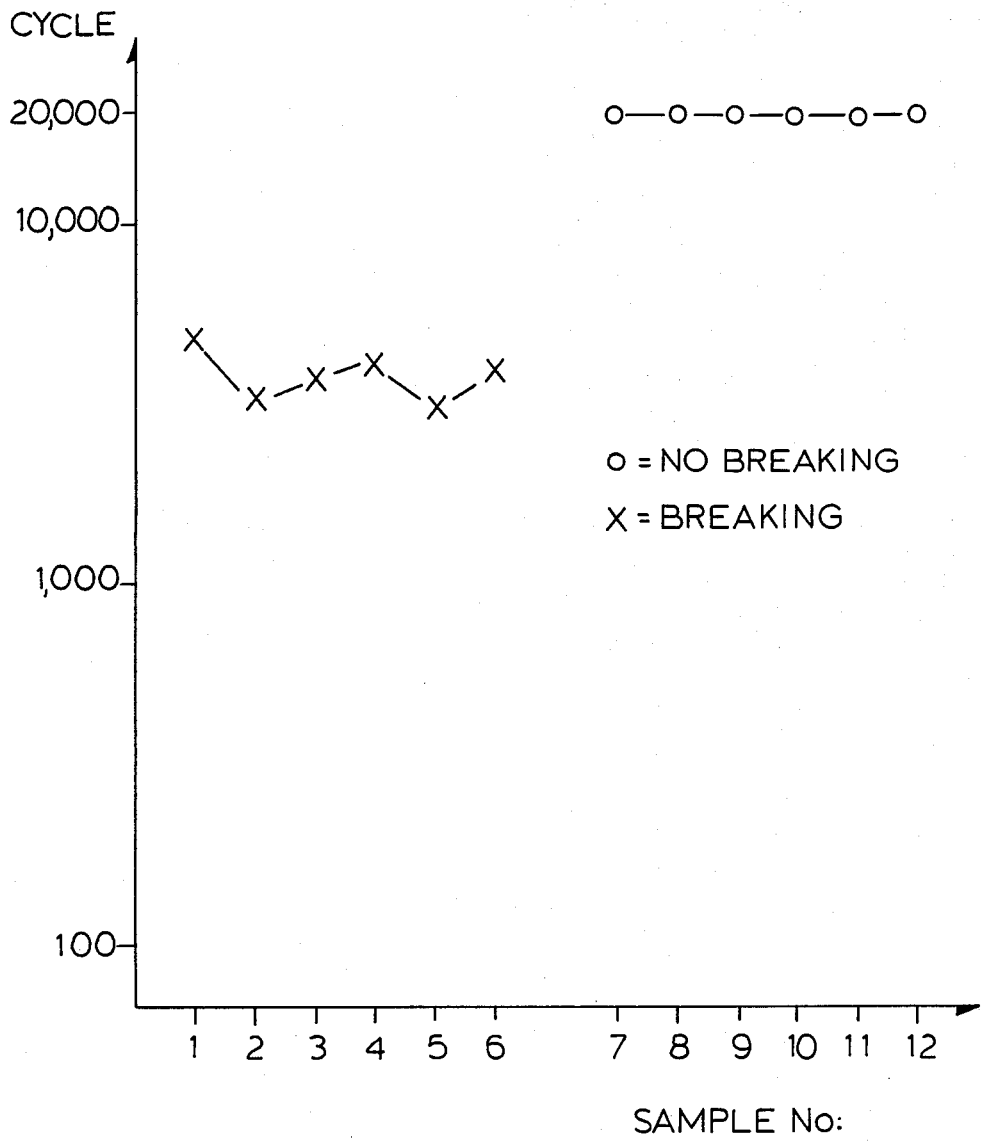
Figure 5:
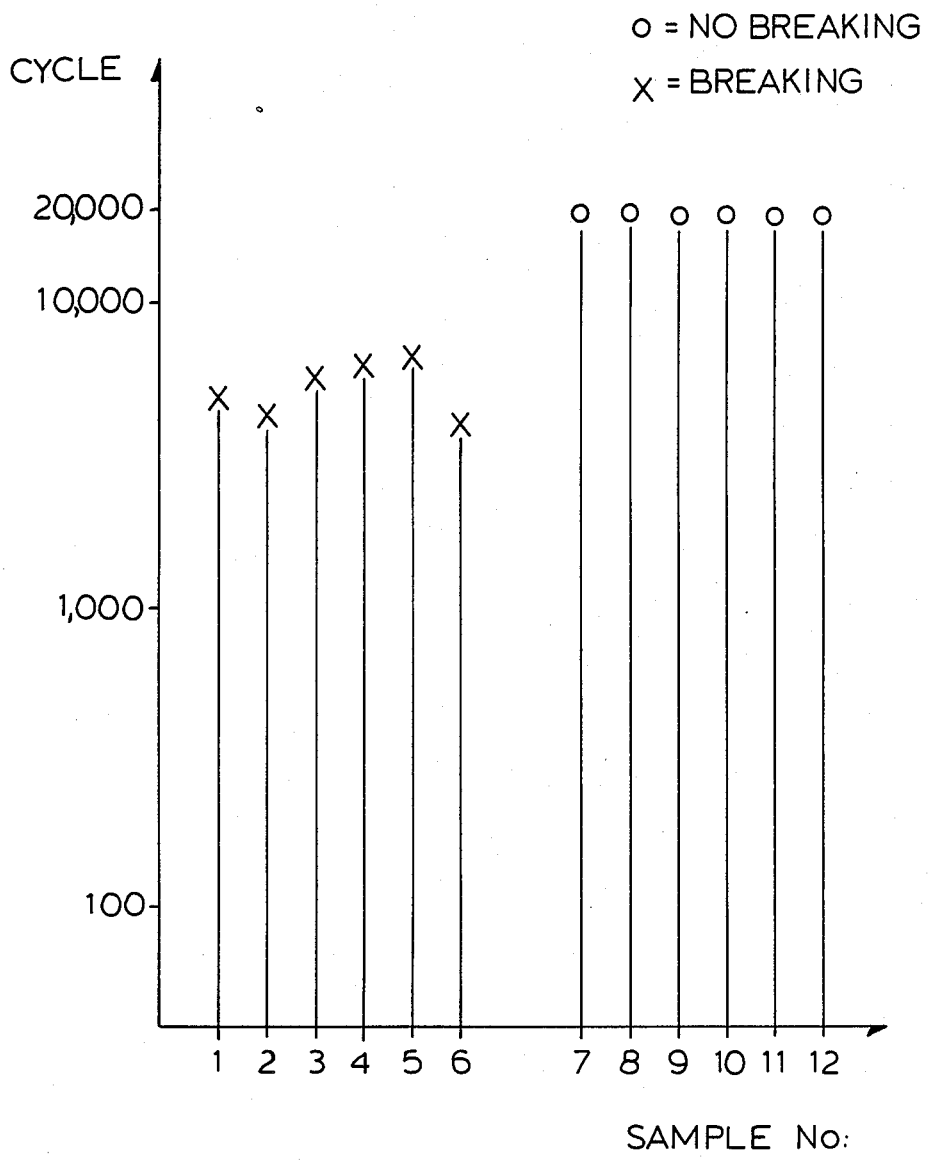
Figure 6:
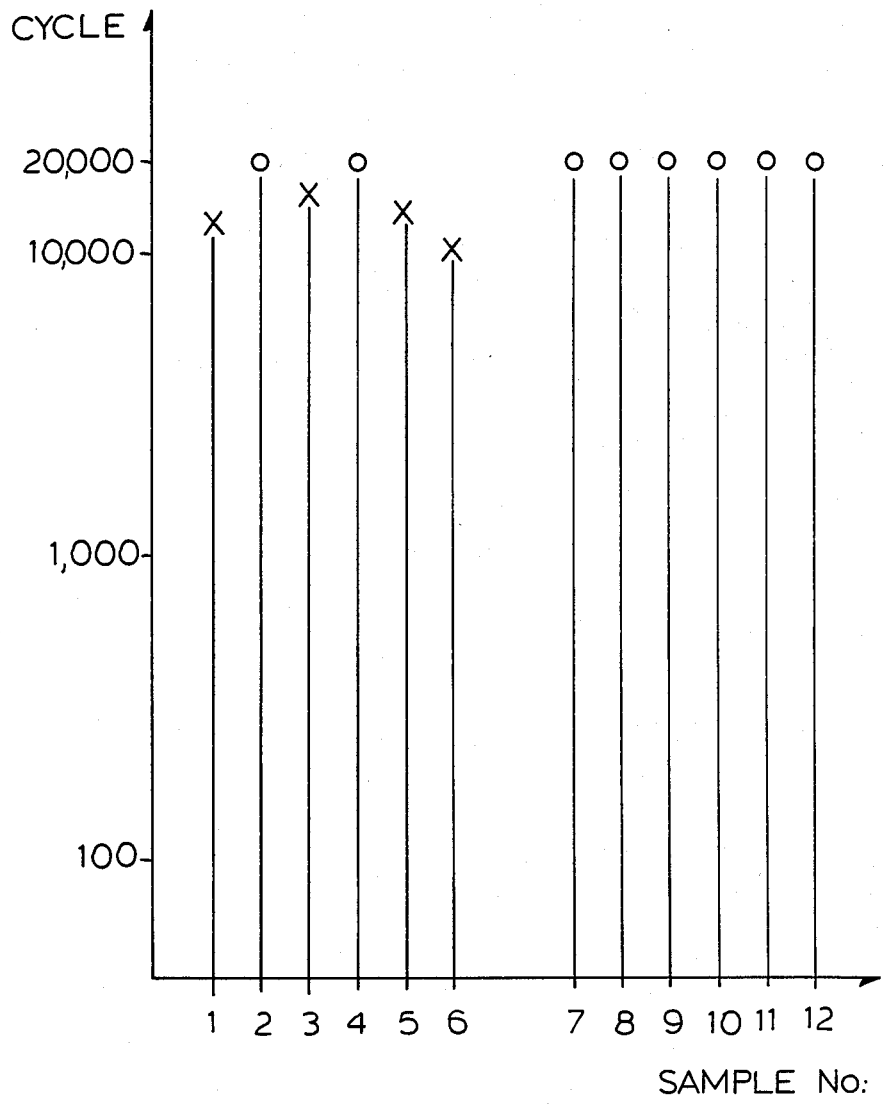
Figure 7:
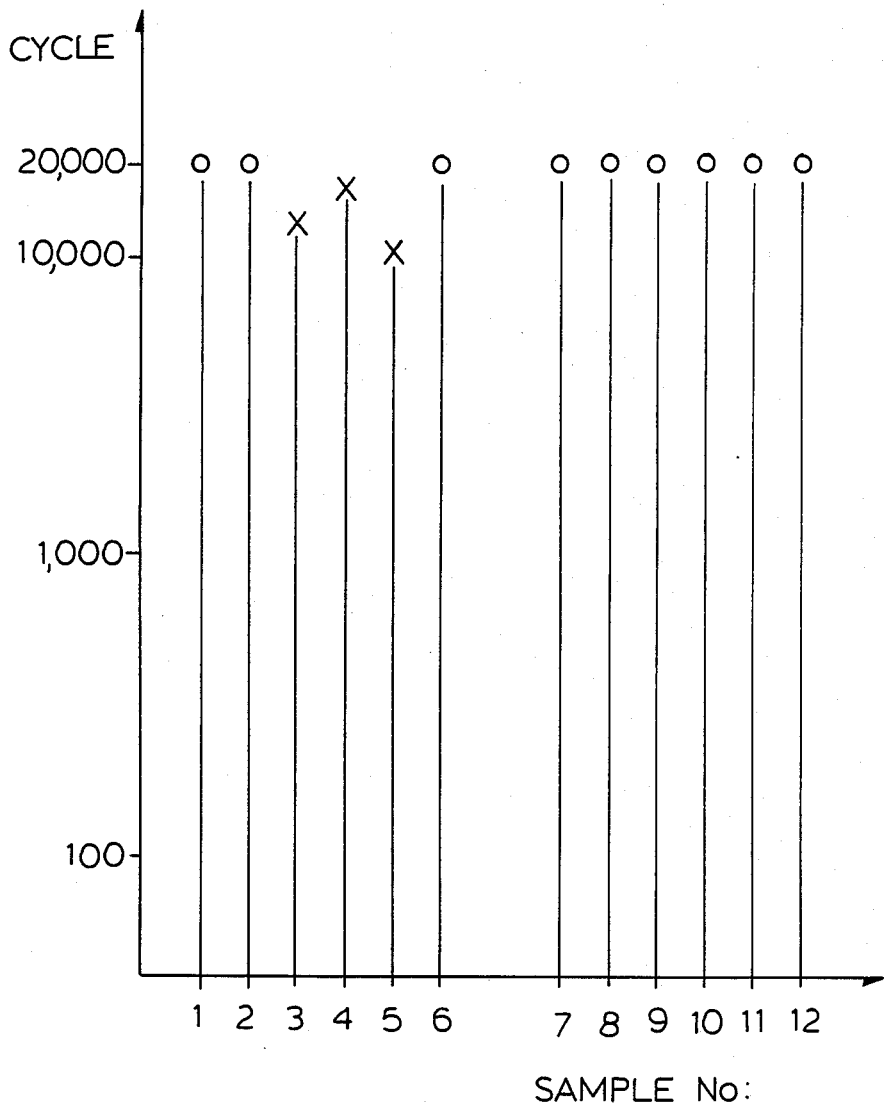
Figure 2:
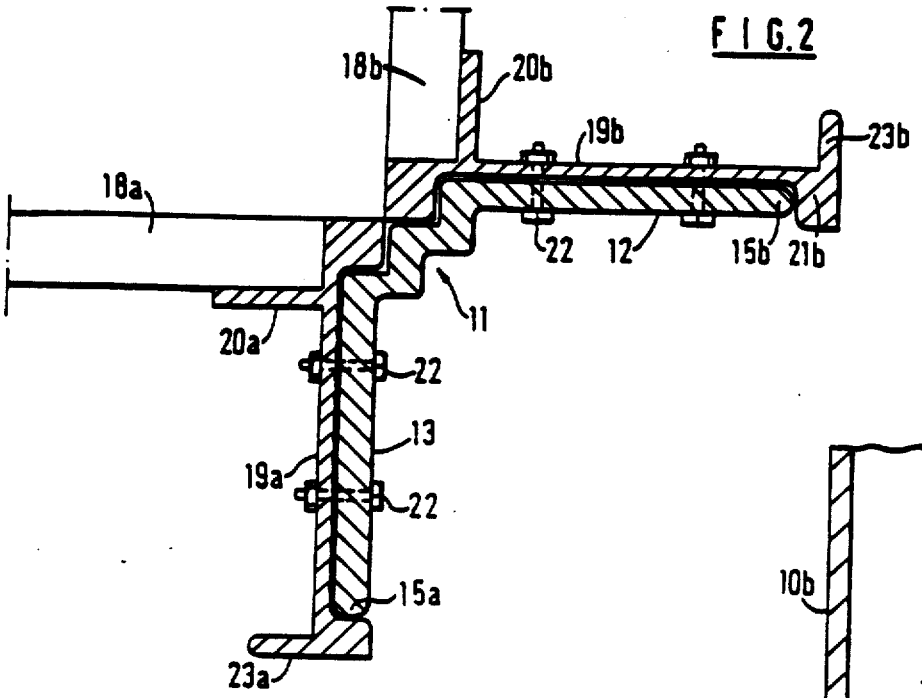
Figure 1:
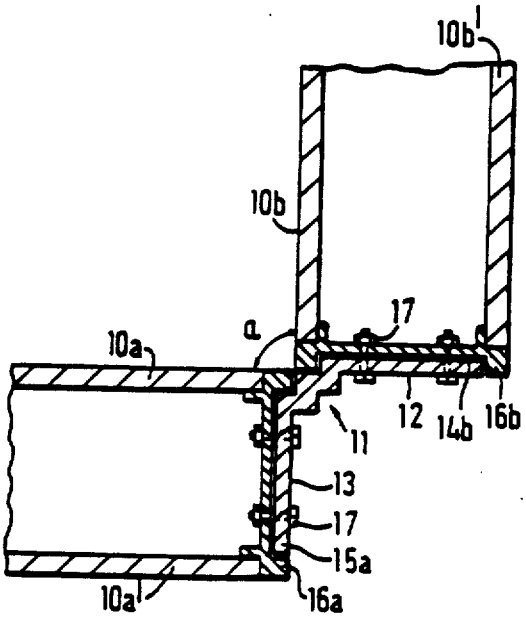
Figure 3:
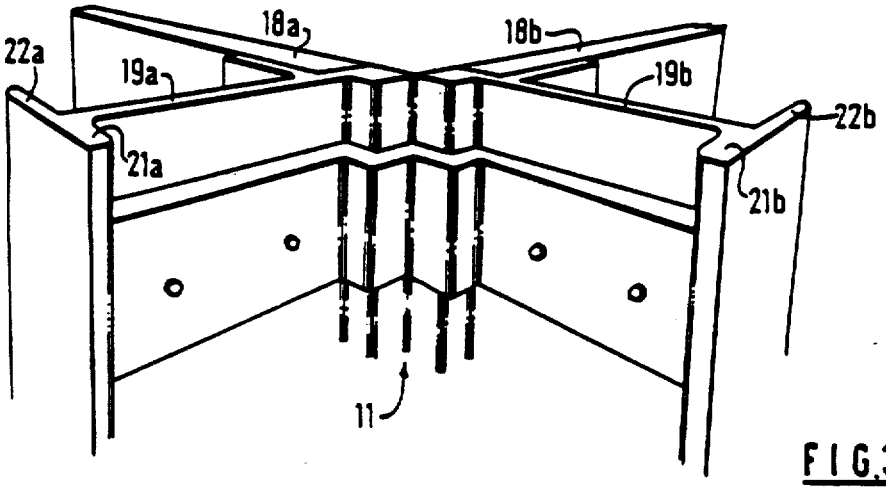

FIG. 3 shows a perspective view of means 11 is disposed relative to the elements 19*a*, 19*b*. As indicated, a second angled portion 23*a*, 23*b*, projects in the opposite direction relative to the angled portion 21*a*, 21*b* and functions as a support for rivets, so that the rivets are not able to become displaced outside and thereby no longer lock together legs of the angled means 11 and the elements 19*a*, 19*b*.

The invention is described in connection with boarding, either by means of boarding cassettes or boarding members, but it can be applied in the production of dismountable containers or boxes of many different types. Such an application can prove to be very interesting because of the great flexibility which the arrangement of the invention makes possible.

I claim:

1. An arrangement for securing two angularly disposed plates together in fixed relation, said arrangement comprising a pair of U-shaped elements, each said element having a bottom, a pair of parallel legs extending perpendicularly from said bottom and at least one flange extending perpendicularly from said bottom in a direction opposite from said legs to define an abutment for a respective plate; and an angled means having a pair of legs defining an angle therebetween, and a stepped part connecting said latter legs, each respective leg of said means being disposed in parallel against said bottom and between said legs of a respective element.

2. An arrangement as set forth in claim 1 which further comprises bolts securing each said leg of said angled means to said bottom of a respective U-shaped element.

3. An arrangement as set forth in claim 1 wherein each element includes a second flange extending from said bottom thereof in parallel to said one flange.

4. An arrangement as set forth in claim 1 wherein said angled means is made of aluminum.

5. In combination, a pair of boarding cassettes disposed in angular relation, each cassette including a pair of spaced parallel plates and a U-shaped element secured to and between said plates, and U-shaped element having a bottom and a pair of legs extending perpendicularly from said bottom, each said leg being in alignment with a respective plate;

an angled means having a pair of legs angularly disposed between said cassettes, each leg of said means being disposed against said bottom and between said legs of a respective U-shaped element; and means securing each leg of said means to said bottom of a respective U-shaped element.

6. The combination as set forth in claim 5 wherein said angled means includes a stepped part connecting said legs thereof.

7. The combination as set forth in claim 5 wherein said plates are made of plywood and said angled means is made of aluminum.

8. The combination as set forth in claim 5 wherein each U-shaped element of a respective cassette includes a pair of flanges extending from said bottom thereof inwardly of and against said plates.

9. In combination a pair of boarding members disposed in angular relation;

a pair of U-shaped elements, each said element extending perpendicularly from an end of a respective boarding member and having a bottom, a pair of legs extending perpendicularly from said bottom and at least one flange extending perpendicularly from said bottom in a direction opposite from said legs to define an abutment for a respective boarding member;

an angled means having a pair of legs defining as angle therebetween, and a stepped part connecting said latter legs, each respective leg of said means being disposed in parallel against said bottom and between said legs of a respective element; and means securing each leg of said means to said bottom of a respective U-shaped element.

10. The combination as set forth in claim 9 wherein one leg of a respective U-shape element is aligned with a respective boarding member.

11. The combination as set forth in claim 9 wherein each boarding member is made of plywood.

12. The combination as set forth in claim 11 wherein said angled means is made of aluminum.

* * * * *

UNITED STATES PATENT AND TRADEMARK OFFICE

CERTIFICATE OF CORRECTION

PATENT NO. : 4,774,989

DATED : October 4, 1988

INVENTOR(S) : Helge Bø

It is certified that error appears in the above-identified patent and that said Letters Patent is hereby corrected as shown below:

The title page should be deleted to appear as per attached title page.

Column 1, lines 5 to 8 cancel "This is ... abandoned."
Cancel Figs. 1 to 7 and substitute attached Figs. 1 to 3

Signed and Sealed this

Seventh Day of January, 1992

*Attest:*

HARRY F. MANBECK, JR.

*Attesting Officer*

*Commissioner of Patents and Trademarks*

United States Patent [19]

Bo

[11] Patent Number: 4,774,989

[45] Date of Patent: Oct. 4, 1988

[54] ARRANGEMENT FOR USE IN JOINING TOGETHER TWO PLATE-SHAPED ELEMENTS

[76] Inventor: Helge Bø, Bøvegen, N-5200 Os, Norway

[21] Appl. No.: 882,916

[22] PCT Filed: Oct. 17, 1985

[86] PCT No.: PCT/NO85/00066

§ 371 Date: Jul. 17, 1986

§ 102(e) Date: Jul. 17, 1986

[87] PCT Pub. No.: WO86/02400

PCT Pub. Date: Apr. 24, 1986

[30] Foreign Application Priority Data

Oct. 18, 1984 [NO] Norway ..... 844153

[51] Int. Cl.[4] ..... E06B 9/00

[52] U.S. Cl. ..... 160/229.1; 160/135

[58] Field of Search ..... 29/526 R, 462; 52/254–257, 280–282, 288, 582; 160/229 R, 231 A, 231 R; 217/65; 249/40, 41, 47, 194, 217–219

[56] References Cited

U.S. PATENT DOCUMENTS 4,144,924 3/1979 Hoek ..... 160/231.2

FOREIGN PATENT DOCUMENTS 1127107 12/1956 France ..... 160/231.2

*Primary Examiner*—Timothy V. Eley

*Attorney, Agent, or Firm*—Kenyon & Kenyon

[57] ABSTRACT

An arrangement for use in joining together two plate-shaped elements (10*a*, 10*b*, 18*a*, 18*b*), especially boarding members, which form an angle (a) usually 90°, with each other, comprises an angled means (11), one leg (12) of which extends substantially at right angles to the main plane of the one plate-shaped element (10*b*, 18*b*) and projects away from the second plate-shaped element (10*a*, 18*a*), and the other leg (13) of which extends substantially at right angles to the main plane of the second plate-shaped element (10*a*, 18*a*) and projects away from the first plate-shaped element (10*b*, 18*b*), legs (12, 13) of the angled means (11) forming abutments against a surface (14*a*, 14*b*) which is rigidly connected to the respective plate-shaped element and is detachably fastened to the latter.

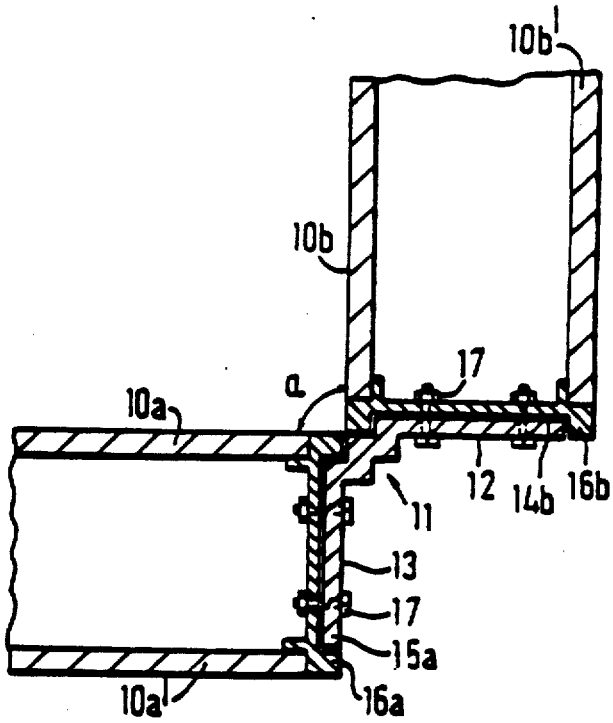

12 Claims, 6 Drawing Sheets